US005148648A

United States Patent [19]

Sorenson et al.

[11] Patent Number: 5,148,648

[45] Date of Patent: Sep. 22, 1992

[54] QUICK-RELEASE FRAME CONNECTOR

[75] Inventors: Gary R. Sorenson, Apple Valley; Philip C. Gerberding, Hopkins, both of Minn.

[73] Assignee: Skyline Displays, Inc., Burnsville, Minn.

[21] Appl. No.: 718,592

[22] Filed: Jun. 21, 1991

[51] Int. Cl.[5] ..... E04H 12/18

[52] U.S. Cl. ..... 52/646; 403/176; 403/328

[58] Field of Search ..... 52/646, 645, 648; 403/169, 171, 230, 328, 176

[56] References Cited

U.S. PATENT DOCUMENTS

| | | | |
|---|---|---|---|
| 1,784,107 | 12/1930 | Parker | 752/726 |
| 4,129,975 | 12/1978 | Gabriel | 403/171 |
| 4,627,210 | 12/1986 | Beaulieu | 52/646 |
| 4,658,560 | 4/1987 | Beaulieu | 52/646 |
| 4,763,459 | 8/1988 | Wesselski | 52/646 |
| 4,907,907 | 3/1990 | Kreusel | 403/171 |
| 4,998,842 | 3/1991 | Sheridan | 52/646 |
| 5,014,484 | 5/1991 | Tanizawa et al. | 52/646 |

*Primary Examiner*—James L. Ridgill, Jr.
*Attorney, Agent, or Firm*—Palmatier & Sjoquist

[57] ABSTRACT

The invention is a quick-release connector to be used with a collapsible display frame structure as taught in U.S. Pat. No. 4,658,560. The invention permits quick coupling and release between a rear and front hub as taught in U.S. Pat. No. 4,627,210. During use, the quick-release connector provides a solid lock when mounted in a coupled position with a hub. The release of the connector from a coupled position occurs upon movement of a slidable sleeve. A spring maintains contact between the slidable sleeve and the connector collar during coupling. Engagement of the slidable sleeve separates the sleeve from the collar permitting the connector to be pulled free from the hub. A split housing couples the connector to the hub. A spring-loaded slidable sleeve maintains the split housing in a locked position. The rear end of the connector is releasably mounted to a hub of a collapsible display frame structure.

21 Claims, 2 Drawing Sheets

QUICK-RELEASE FRAME CONNECTOR

BACKGROUND OF THE INVENTION

Collapsible display frames, as taught in the Beaulieu U.S. Pat. No. 4,658,560, have been extremely valuable, successful, and useful to salesmen or distributors particularly when utilized at trade shows. A collapsed display frame compacts into a convenient size and weight for storage or transportation. The usefulness and convenience of a collapsible display frame is limited by the ease of the frame's erection and disassembly. Erection and disassembly as known in the art involve a time-consuming and tedious process of attaching conventional connectors between hubs as taught in the Beaulieu U.S. Pat. No. 4,627,210.

The present quick-release frame connector invention greatly enhances the efficient erection and dismantling of certain types of collapsible display frames, thereby providing salesmen or distributors with additional time to pursue alternative business endeavors. The improved durability of the quick-release frame connector increases the useful life of a collapsible display frame. The present invention also improves the design, utility and construction of a connector thereby increasing a connector's useful life.

SUMMARY OF THE INVENTION

The invention is a quick-release connector to be used with a collapsible display frame structure as taught in the Beaulieu U.S. Pat. No. 4,658,560. The invention permits quick coupling and release between a rear and front hub as taught in the Beaulieu U.S. Pat. No. 4,627,210. During use the quick-release connector provides a solid lock when mounted in a coupled position with a hub. The release of the connector from a coupled position occurs upon movement of a slidable sleeve. Acompression spring maintains contact between the slidable sleeve and the connector collar during coupling. Engagement of the slidable sleeve separates the sleeve from the collar permitting the connector to be pulled free from the hub. A split housing mechanism couples the connector to the hub, and the spring-loaded slidable sleeve maintains the split housing in a locked position. The rear end of the connector, containing the connector collar, is preferably releasably mounted to a rear hub of a collapsible display frame structure. The opposite end of the connector is preferably fixedly mounted to a front hub.

An object of the invention is to enhance the efficiency in erection and disassembly of certain types of collapsible display frames.

Another object of the invention is to provide an improved, durable and convenient connector between hubs of a collapsible display frame.

Still another object of the invention is to increase the useful life of a collapsible display frame.

Still another object of the invention is to prolong the useful life of a connector used with a collapsible display frame.

Still another object of the invention is the provision of a new and improved connector of relatively simple and inexpensive construction and operation, which is safe, durable, convenient and performs consistently in conjunction with a collapsible display frame, with reduced likelihood of damage to property, equipment and injury to persons.

A feature of the invention is the solid locking engagement between the invention and a hub of a collapsible display frame.

Another feature of the invention is the split tubular design of the quick-release connector housing.

Still another feature of the invention is the spring-loaded slidable sleeve mechanism providing convenient locking or release of the connector to a hub.

Still another feature of the invention is an internal compression spring providing the means for releasable movement of the slidable sleeve.

Still another feature of the invention is a collar stop maintaining the slidable sleeve in a desired position.

Still another feature of the invention is a notch for positioning the compression ring in a desired location.

Still another feature of the invention is the rear interior ridge for maintaining engagement between the split tubular connector housing and the boss or bayonet of a hub.

Still another feature of the invention is a notch located on the forward end of the split tubular connector housing for engagement with another compression ring.

Still another feature of the invention is the forward interior ridge maintaining engagement between the connector housing and the boss or bayonet of an opposite hub.

Still another feature of the invention is another compression ring for use in conjunction with the forward notch in maintaining the forward end of the connector housing in a fixed position.

DETAILED DESCRIPTION OF THE PREFERRED EMBODIMENT

Figure 2:
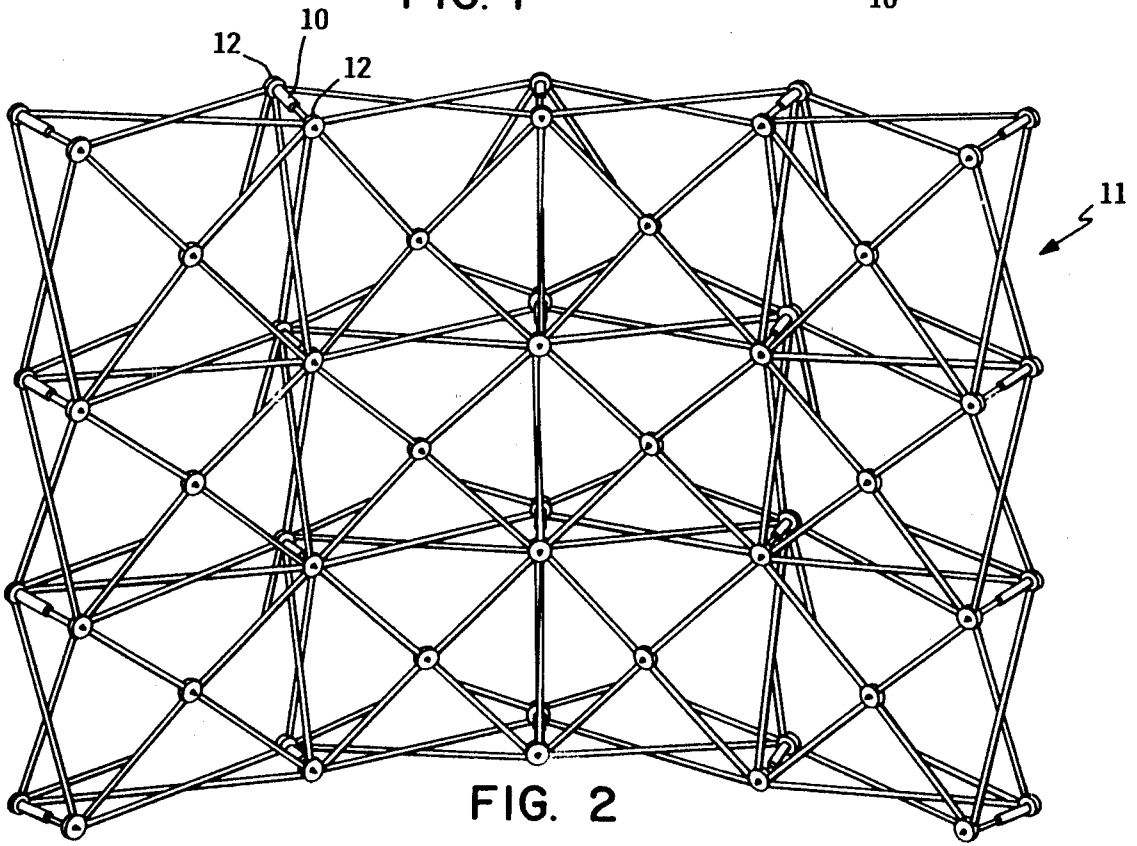
FIG. 2 shows a frame of the type used with the invention.

One form of the invention is illustrated and described herein. The improved quick-release frame connector is indicated in general by the numeral 10. The quick-release frame connector 10 is generally used in conjunction with a collapsible display frame 11 as taught in the Beaulieu U.S. Pat. No. 4,658,560, and shown in FIG. 2. The connector 10 couples to a hub assembly 12 as taught in the Beaulieu U.S. Pat. No. 4,627,210, shown in FIG. 3. The parts of the quick-release frame connector 10 are preferably molded, constructed or made of durable, resilient plastic such as nylon, Delrin or the like, which have inherent lubricity. The quick-release connector 10 is generally tubular in construction and has a preferred length of about 14.5 cm and diameter of about 1.5 cm. The quick-release connector 10 may suitably be enlarged or reduced in length and diameter in order to satisfy the particular dimensional requirements of the corresponding hub assemblies 12 and collapsible display frame 11.

Figure 1:
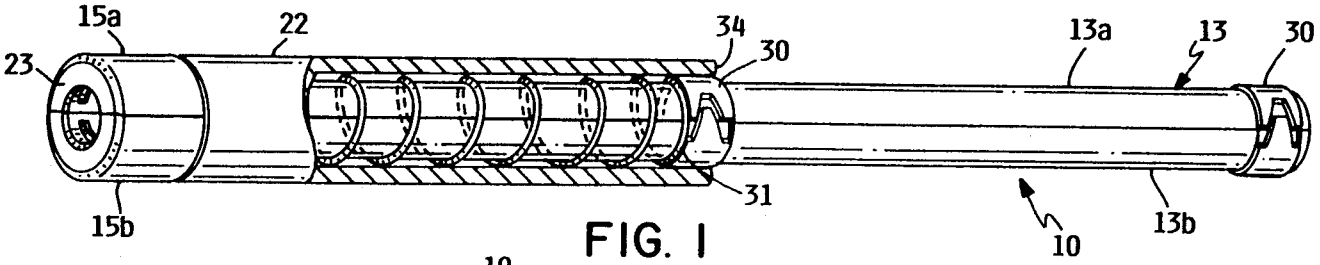
FIG. 1 shows an isometric view of the invention in partial cross section.

The quick-release connector 10 is preferably made of a longitudinally split cylindrical tubular housing 13. The housing 13 may be split over its entire length, thereby defining two identical portions 13*a* and 13*b*. The split tubular housing 13 preferably remains hollow, providing rigid support for a collapsible display frame 11. The quick-release connector 10 is of lightweight construction, thereby, allowing convenient transportation of a collapsible display frame 11. The opposite identical portions 13*a* and 13*b* of the longitudinally split cylindrical tubular housing 13 will preferably remain in a flush confrontational relationship to each other as seen in FIG. 1.

Figure 3:
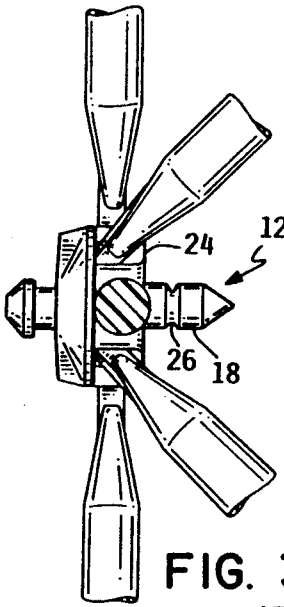
FIG. 3 shows a side view of a typical frame hub.

At one end of the tubular housing 13 is located a split collar 15*a*, 15*b*. The collar 15*a*, 15*b* encircles an opening 16 (FIG. 5A). The opening 16 may be suitably expanded along the confrontational edge between the identical collar portions 15*a*, 15*b*. The opening 16 is preferably expanded in order to facilitate the coupling of the quick-release connector 10 to a bayonet 18 of a hub assembly 12 (FIG. 3). A ridge 20 is formed between the rearward edge of the collar 15*a*, 15*b* and the cylindrical tubular housing 13*a*, 13*b*. The ridge 20 functions as a stop preventing forward movement of the slidable sleeve 22 from a desired position.

The forward edge 23 of the collar 15 couples in flush contact with the body 24 of the hub assembly 12. An interior ridge 25 is located inside the collar opening 16 suitably rearward of the forward edge 23. The interior ridge 25 is preferably molded to the interior of the two identical portions 13*a*, 13*b* and is made of the same material. During coupling, the interior ridge 25 fits in flush contact with a groove 26 located in the bayonet 18 of the hub assembly 12. The collar 15 resiliently couples the quick-release connector 10 to the hub assembly 12.

Figure 4:
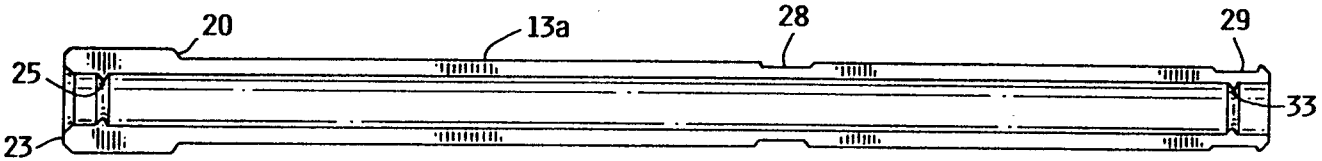
FIG. 4 shows one section of the split tubular housing.
Figure 6:
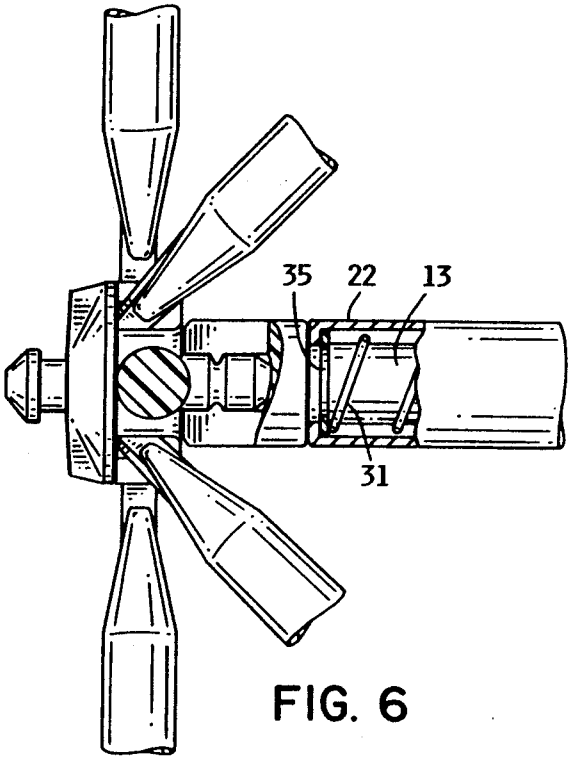
FIG. 6 shows the invention in engaged position with a hub.
Figure 5B:
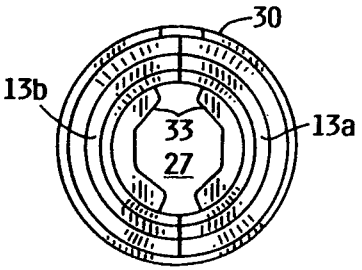
FIG. 5B shows a second end view of the invention.
Figure 5A:
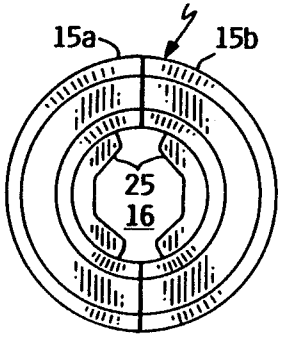
FIG. 5A shows a first end view of the invention.

The cylindrical tubular housing extends rearward to an opening 27 (FIGS. 4 and 5B). A spring notch 28 is preferably located equidistant between the ridge 20 and the opening 27. An attachment notch 29 is preferably located forward the opening 27. The notches 28, 29 are preferably 0.5 cm in width and 0.05 cm in depth and are preferably molded into the tubular housing 13. The notches 28, 29 preferably define the location for the compression rings 30. The spring notch 28 in conjunction with a compression ring 30 serves a dual purpose of affixing the two identical portions 13*a*, 13*b* of the cylindrical tubular housing 13 together in a confrontational relationship to each other and acts as a spring stop preventing disengagement of a spring 31 upon movement of the slidable sleeve 22 in a rearward direction toward the opening 27. The attachment notch 29 in conjunction with a compression ring 30 serves a dual purpose of affixing the two identical portions 13*a*, 13*b* of the cylindrical tubular housing 13 in a confrontational relationship to each other and fixedly fastens the opening 27 to a bayonet 18 of a second hub assembly 12.

The opening 27 is preferably fixedly attached for flush contact with the body 24 of a hub assembly 12. An interior ridge 33 is located inside the opening 27. The interior ridge 33 is preferably molded to the interior of the two identical portions of the tubular housing 13 suitably forward the opening 27 and is made of the same material as the tubular housing 13. The interior ridge 33 fits in flush contact with a groove 26 located in the bayonet 18 of a second hub assembly 12. Attachment of the frame connector 10 to a collapsible display frame 11 results upon the insertion of bayonet 18 into the opening 27 for a suitable distance such that the interior ridge 33 fits into and flushly contacts the groove 26 of a hub assembly 12. Compression ring 30, affixed at the location of the attachment notch 29, fixedly attaches the frame connector 10 to a collapsible display frame 11. The frame connector 10 remains continuously affixed to a display frame 11 at the rearward location of the opening 27. Frame connector 10 is releasably coupled to a display frame 11 at the forward location of the collar opening 16.

The compression spring 31 is preferably constructed of 0.022 gauge piano wire having a contraction force of $\frac{3}{4}$ to $1\frac{1}{2}$ pounds. The compression spring is suitably 6.0 centimeters in diameter, slightly larger than the diameter dimension of the cylindrical tubular housing 13. The diameter of the spring 31 is less than the diameter of the open end of the slidable sleeve 22. The compression spring is generally spiral in configuration and may maintain a larger or smaller length and/or contraction force as desired in coupling the quick-release connector 10 to a hub assembly 12. After coupling, the compression spring 31 maintains the slidable sleeve 22 in continuous flush contact with the ridge 20 of the collar 15.

During assembly, the compression spring 31 may be inserted into the open end 34 of the slidable sleeve 22, whereon, the cylindrical tubular housing 13 may be inserted first through the opening 35 of the slidable sleeve 22 and then through the center of the spring 31. The slidable sleeve 22 and the spring 31 may then be positioned preferably with one end of the spring 31 maintaining contact between the inside flange which forms opening 35 of the slidable sleeve 22 and the opposite end of the spring 31 positioned for contact with the compression ring 30, which is slidably positioned to seat into the spring notch 28. The rearward end of the spring 31 is maintained in position by the compression ring 30. The spring 31 provides the return mechanism for releasably coupling and uncoupling the quick-release connector 10 to a hub assembly 12.

The slidable sleeve 22 is generally tubular in construction and preferably molded of the same or sufficiently similar material as the cylindrical tubular housing 13. Preferably the slidable sleeve 32 is 6.0 centimeters in length with the diameter of the open end 34 being approximately 1.2 centimeters. The diameter of the opening 35, opposite the open end 34, is preferably 0.8 centimeters or slightly larger than housing 13. Movement of the slidable sleeve 22 in a rearward direction, toward the opening 27, will disengage contact between the ridge 25 and the groove 26 of bayonet 18. The termination of contact between the groove 26 and the ridge 25 will permit the separation or expansion of the collar 15 along the confrontational edge of the two identical portions thereby providing the mechanism for coupling and uncoupling the collar 15 to a bayonet 18 of a hub assembly 12.

Preferably the exterior diameter of the slidable sleeve 22 will be substantially equal to the exterior diameter dimension of the collar 15.

The diameter of the spring 31 is larger than the diameter of the opening 35, thereby preventing disengagement between the spring 31 and the slidable sleeve 22.

The quick-release connector 10 is preferably assembled by positioning of the two identical portions of the cylindrical tubular housing 13 in a confrontational relationship to each other. The spring 31 is then inserted into the open end 34 of the slidable sleeve 22. The rearward opening 27 of the cylindrical tubular housing 13 is then inserted into the opening 35 of the slidable sleeve 22 while the spring 31 is maintained inside the sleeve 22. The cylindrical tubular housing 13 is then inserted until the sleeve 22 makes contact with the rearward edge 20 of the collar 15. A compression ring 30 is then slidably affixed to the cylindrical tubular housing 13 at the location of the spring notch 28, thereby affixing the two identical portions 13*a*, 13*b* together in the desired confrontational relationship and maintaining the spring 31 in a desired location in the slidable sleeve 32.

Interaction between the quick-release connector 10 and a display frame 11 initially involves the fixed attachment of the rearward opening 27 to a bayonet 18 of a hub assembly 12. The cylindrical tubular housing 13 may be expanded along the confrontational edge sufficient for the insertion of the bayonet 18 into the opening 27. Upon engagement between the interior ridge 33 and the groove 26, the compression ring 30 in the attachment notch 29 resiliently attaches the quick-release connector 10 to the hub assembly 12.

The releasable coupling mechanism of the connector 10 may be implemented by engagement of the slidable sleeve 22 in rearward direction toward the opening 27. Movement of the slidable sleeve 22 compresses the spring 31. The opening 16 of the collar 15 may then be enlarged along the confrontational edge to receive the bayonet 18 of a second hub assembly 12. Upon engagement between the ridge 25 and the groove 26 of the second hub assembly 12 the expansion of the opening 16 will terminate and flush contact between the confrontational edges will again occur. Release of the slidable sleeve will cause the compressed 31 to expand, moving the slidable sleeve 22 into a locked configuration about the tubular housing 13.

The convenience of the quick-release connector 10 is apparent providing the users of a collapsible display frame 11 with a durable and efficient mechanism for coupling of a connector 10 to hub assembles 12 in the assembly and dismantling process. For any particular collapsible display frame 11, any number of quick-release connectors 10 may be used to provide the necessary degree of stability for the frame.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A quick-release frame connector for use with a collapsible display frame structure having hub assemblies comprising:

a) a cylindrical tubular housing portion having:
   (i) a split first end portion having a collar portion;
   (ii) an elongate central portion; and
   (iii) a second end portion;

b) a compression spring member encircling said elongate central portion; and c) a cylindrical tubular sleeve portion having a first end for engagement with the first end of the spring member, and enclosing the spring member and a portion of the elongate central portion, said first end also adapted for abutment with said collar portion; and d) means for affixing a second end of said spring member to a predetermined position along said elongate central portion.

2. The apparatus of claim 1, wherein said first end portion further comprises an internal ridge portion adapted for engagement with a hub assembly.

3. The apparatus of claim 1, wherein said second end portion further comprises an internal ridge portion adapted for engagement with a hub assembly.

4. The apparatus of claim 1, wherein said first end portion is adapted for releasable coupling with a hub assembly.

5. The apparatus of claim 1, wherein said second end portion is adapted for fixable mounting to a hub assembly.

6. The apparatus of claim 1, wherein said elongate central portion further comprises a notch portion adapted for engagement with said means for affixing the second end of said spring.

7. The apparatus of claim 6, wherein said means for affixing the second end of said spring comprises a compression ring adapted for engagement with the spring member and the notch portion.

8. The apparatus of claim 1, wherein said second end portion further comprises a second notch portion.

9. The apparatus of claim 8, further comprising a compression ring adapted for engagement to said second notch portion.

10. The apparatus of claim 1, wherein said cylindrical tubular housing portion is longitudinally split into two identical portions.

11. The apparatus of claim 10, wherein the two longitudinally split portions of the cylindrical tubular housing portion confront each other, adapted for flush contact therebetween.

12. The apparatus of claim 11, wherein said cylindrical tubular sleeve portion is adapted for slidable engagement over the two longitudinally-split portions of the cylindrical tubular housing portion.

13. A quick-release frame connector for use with a collapsible display frame structure having hub assemblies comprising:

a) a pair of longitudinally-split cylindrical tubular housing portions, having:
   (i) a pair of first end portions having collar portions;
   (ii) a pair of elongate central portions; and
   (iii) a pair of second end portions;
   where said pair of longitudinally split cylindrical tubular housing portions are adapted for confrontational relation and flush contact to each other;

b) a spring member fitted over the elongate central portions; and c) a cylindrical tubular sleeve adapted for slidable engagement with the central portions, further adapted for engagement with the spring member, and further adapted for abutment with the collar portions.

14. The apparatus of claim 13, wherein said first end portions further comprise internal ridge portions adapted for engagement with a hub assembly.

15. The apparatus of claim 13, wherein said second end portions further comprise internal ridge portions adapted for engagement with a hub assembly.

16. The apparatus of claim 13, further comprising compression rings clamped to said notch portions of the second end portions.

17. The apparatus of claim 13, wherein said cylindrical tubular sleeve portion is adapted for slidable engagement with the spring portion and the longitudinally-split cylindrical tubular housing portions.

18. The apparatus of claim 13, wherein said first end portions are adapted for releasable coupling with the hub assembly.

19. The apparatus of claim 13, wherein said second end portions are adapted for fixable mounting to a hub assembly.

20. The apparatus of claim 13, wherein said elongate central portions further comprise notch portions adapted for engagement with the spring member.

21. The apparatus of claim 20, further comprising compression rings seated in said notch portions.

* * * * *